United States Patent [19]

Lichter

[11] 4,020,532

[45] May 3, 1977

[54] ONE PIECE MOLDED DEVICE

[76] Inventor: Sigmund J. Lichter, 2869 Selby Ave., Los Angeles, Calif. 90064

[22] Filed: Oct. 9, 1974

[21] Appl. No.: 513,343

[52] U.S. Cl. ..... 24/255 R; 24/73 R; 210/469; 220/90.4

[51] Int. Cl.[2] ..... B01D 35/02; A44G 21/00

[58] Field of Search ..... 40/1.5; 210/469, 470, 210/155; 215/100, 101; 24/3 H, 3 L, 255 AS, 255 S, 259 SH, 261 A, 255 R, 84 B, 73 B, 81 B, 67.9; 248/316 D, 226 E; 220/90.4, 90.2

[56] References Cited

UNITED STATES PATENTS

| | | | |
|---|---|---|---|
| 1,146,645 | 7/1915 | Morehouse | 24/259 GC |
| 1,467,928 | 9/1923 | Eagles | 24/259 PF |
| 1,967,427 | 7/1934 | Puckett | 24/261 A |
| 1,995,226 | 3/1935 | Reilly | 24/259 A |
| 2,106,453 | 1/1938 | Ekdahl | 215/100 R |
| 2,549,200 | 4/1951 | Hooks | 248/316 D |
| 2,744,631 | 5/1956 | Toombs | 215/100 R |
| 2,815,813 | 12/1957 | Goldberg | 24/259 FC |
| 2,930,156 | 3/1960 | Jones | 248/316 D |
| 3,144,950 | 8/1964 | Rosenheim | 215/100 R |
| 3,289,850 | 12/1966 | Gubash | 210/470 |
| 3,734,155 | 5/1973 | Stenger | 24/259 R |

FOREIGN PATENTS OR APPLICATIONS

| | | | |
|---|---|---|---|
| 804,445 | 7/1935 | France | 210/469 |
| 179,836 | 5/1922 | United Kingdom | 215/101 |
| 1,006,974 | 12/1963 | United Kingdom | 24/11 |
| 18,870 | 9/1898 | United Kingdom | 24/259 GC |
| 930,934 | 7/1963 | United Kingdom | 24/255 R |
| 748,514 | 5/1956 | United Kingdom | 24/259 FF |

*Primary Examiner*—Bernard A. Gelak
*Attorney, Agent, or Firm*—Poms, Smith, Lande & Glenny

[57] ABSTRACT

A one piece molded plastic device includes a body presenting a face that can receive indicia and an integral clip having convergent sidewalls depending from an integral bight portion. One of the sidewalls is connected to the body and the other sidewall is longer than the first sidewall and extends below the body. The clip is positionable over marginal portions along the free edge of generally thin objects. The device has been improved by adding a pair of laterally spaced ribs. The ribs are formed integrally and longitudinally of the second sidewall and protrude toward the body for gripping the marginal portion of the objects therebetween. A deformable hinge may also be provided integrally with the body and clip where the first sidewall is connected to the body for selectively adjusting the relative orientation of the body and the clip as desired.

2 Claims, 4 Drawing Figures

ONE PIECE MOLDED DEVICE

BACKGROUND OF THE INVENTION

The device has its greatest applicability as a retainer of large solids within a drinking glass while permitting liquid to be drunk therefrom. It has previously been proposed to provide a strainer or the like for insertion in the mouth of liquid containers. For example, Ekdahl, U.S. Pat. No. 2,106,453, Swing, No. 2,357,063, and Smith No. 2,265,403 all teach devices which are adapted to fit onto drinking glasses to hold ice or other solids within the glass while permitting the liquid to be drunk therefrom. It has been found that prior art devices easily slip from their required orientation so that they either must be held while drinking or, if they are not held, there is the possibility that they will slip and allow the ice to flow from the glass. This can result in spilling liquid and ice on the users face and body. Therefore, one of the objects of the invention is to provide a device which will securely hold the drinking glass to minimize the changes of spilling.

Another object of the present invention is to provide a guard for a drinking glass which will be very inexpensive to manufacture and which will have an indicia carrying face to receive advertisements or the like. Preferably, the device could be given away by high volume food stands and restaurants to customers buying a beverage. The indicia would either be a printed message on the face of the device or the face would be of such a shape that it would represent the logo or other symbol of the restuarant or beverage manufacturer. Because these devices may be a free premium, they must be extremely low cost. Therefore, it is advantageous to manufacture them from one piece molded plastic because plastic is inexpensive and because a one piece molded device eliminates necessary assembly steps. It is another object of the invention to provide a device which will have a secondary function other than holding ice and other solid objects within a glass. The advertiser who is giving away the device to customers buying his product whould find it advantageous if the advertisement on the device could be seen by others than just the original purchaser of the beverage. Moreover, others seeing the device used in a second useful manner may buy the beverage at the restaurant in order to obtain such a device for his own use. Therefore, it is an object to provide such a secondary use for the invention. The above objects and other objects are met by the present invention which is described in detail below.

SUMMARY OF THE INVENTION

A one piece molded plastic device includes a body presenting a face which can receive indicia thereon and an integral clip having convergent side walls depending from an integral bight portion. The first side wall is connected to the body and the second side wall is longer than the first side wall and extends below the body. The clip is poitionable over marginal portions along the free edge of a generally thin object such as a drinking glass. The invention includes the improvement of providing a protrusion on the second side wall protruding toward the body for gripping the marginal portion of the object therebetween. The protrusion includes a pair of laterally spaced ribs formed integrally and longitudinally of the second side wall. In order for the invention to have a potential for secondary utilization, a deformable hinge is formed integrally of the body and the clip where the first side wall is connected to the body for selectively adjusting the relative orientation of the body and the clip is desired. In that way, the body could be oriented generally perpendicular to its original orientation so that the invention could be worn as a badge over a shirt pocket. The device as summarized above is manufactured generally by molding the device of resilient material in a mold. The method has been improved by providing the mold with a pattern whereby the side walls diverge from the bight portion to the bottom thereof so that the device may be easily removed from the mold, but upon the cooling of the resilient material, the bight portion contracts causing convergents of the bottom portion of the side walls from the bight portion. In that way, the clip portion is resiliently urged together to more securely hold the drinking glass or other thin object.

BREIF DESCRIPTION OF THE DRAWINGS

DETAILED DESCRIPTION OF THE PREFERRED EMBODIMENT

Figure 1:
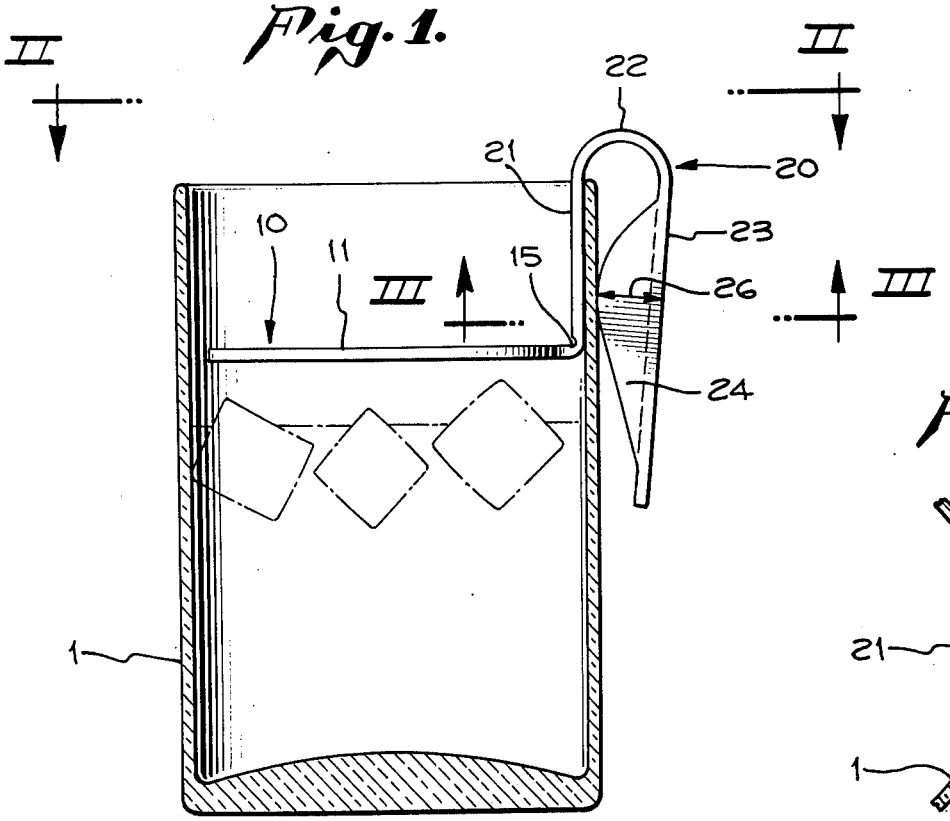
FIG. 1 shows the one piece molded plastic device embodying the improvements of the present invention. The device is shown attached to a drinking glass with liquid and ice therein.

The one piece molded plastic device includes a body presenting a face which can receive indicia and an integral clip having convergent side walls depending from an integral bight portion. In the exemplary embodiment, the body 10 presents an indicia receivable face 11. The clip 20 has convergent side walls 21 and 23 connected by an integral bight portion 22 therebetween. As shown in FIG. 1, the device is mounted on a beverage glass 1 with liquid therein. The body 10 has openings 12 therethrough to allow for passage of the liquid. It should be recognized that the openings 12 are not absolutely necessary because liquid can pass between the side of the body 10 and drinking glass. The body can be any desired shape.

The first side wall 21 is connected to the body portion, and the other side wall 23 is longer than the first side wall 21 and extends lower than the body.

Figure 3:
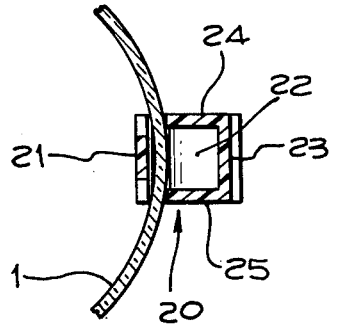
FIG. 3 is a sectional view through the plane III—III in FIG. 1 and shows the first side wall and the protruding ribs of the second side wall gripping the drinking glass.
Figure 2:
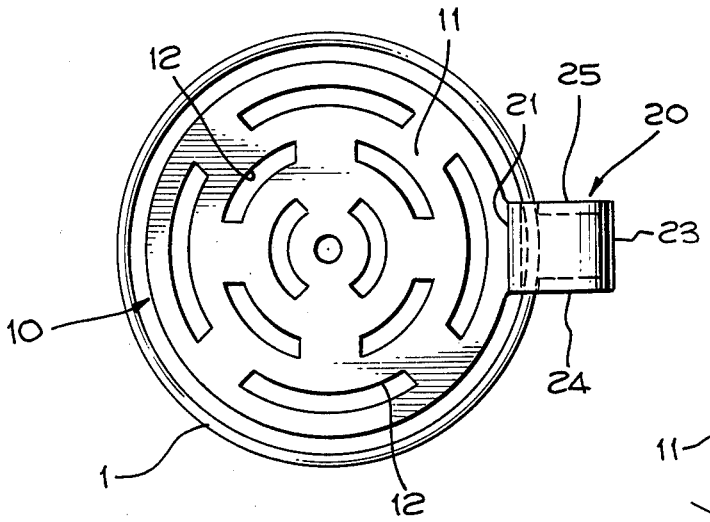
FIG. 2 is a plan view of the device of the present invention and is taken along the place of II—II of FIG. 1.

Protrusion means are provided which comprise a pair of laterally spaced ribs formed integrally and longitudinally of the second side walls and protruding toward the body for gripping the marginal portion of objects therebetween. In the exemplary embodiment, such protrusion means includes ribs 24 and 25 formed integrally with the second side wall 23. As shown in FIG. 3, the ribs contact the beverage glass 1 so that the clip is securely held to the beverage glass. The clip is made of a resilient plastic material and is formed in such a way that it is resiliently urged toward the drinking glass in order to securely hold it.

The ribs each have a generally curved edge contacting the flat object. The curved edge intersects the thin object above and on the other side of the object from the intersection of the first side wall with the body to assist in gripping the thin object. The widest section of the rib is above the intersection of the body and the first side wall for better gripping the object by the device. As more clearly shown in FIGS. 1 and 4, in the exemplary embodiment, the curved ribs have their widest point above the intersection of the body 10 with the first side wall 21. This widest dimension is indicated by dimension 26. It has been found that by having the intersection of the ribs with the glass above the intersection of the body 10 and the first side wall 21, much better gripping of the device with the glass is accomplished. Moreover, the preferred method of assuring that the protrusion will grip the glass above the aforementioned intersection is to design the curvature of the ribs so that the intersection with the glass occurs at its widest dimension.

Figure 4:
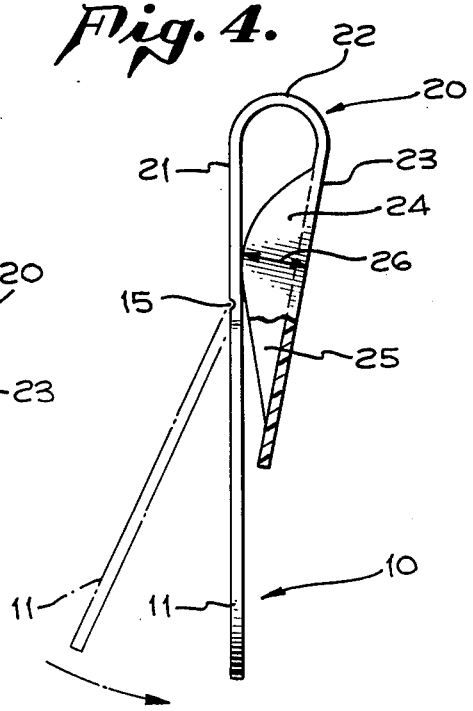
FIG. 4 shows the orientation of the body after the body has been pivoted about the deformable hinge so that the device could be used as a badge.

The invention may also be improved by providing deformable hinge means integrally with the body and the clip where the first side wall is connected to the body for selectively adjusting the relative orientation of the body and the clip as desired. Deformable plastic hinges are formed in the device during the molding process. Essentially, the hinge is merely a narrowed portion which is easily deformable. The original resiliency in the clip maintains the original orientation. However, when it is desired to use the body portion in another orientation, a slight force on the body will deform the hinge and allow the body to pivot with respect to the clip. As shown in FIG. 4, the body 10 is pivoted to an orientation approximately 90° from the original orientation. In the FIG. 4 orientation, the device could be worn by placing the clip portion over a shirt pocket. The face 11 of the body can therefore become a badge or message button so that a secondary function is provided for the device. The badge displays the advertising message on the body to notify others of the company dispensing the device.

The first side wall may be tapered from a wider portion at the bight portion to a narrow portion near the hinge means for assisting in bending the face relative to the first side wall especially if the body is circular. The hinge means should be straight to insure ease of bending, but if body 10 is circular, it may be awkward to have a long straight side at the hinge. Therefore, the optional feature of tapering the first side wall is provided. However, because the first side wall 21 is narrow relative to the body 20 in the exemplary embodiment, the hinge does not intersect a very large arch of the circle. Therefore, the tapered first side wall is not shown in the drawings of the exemplary embodiment.

The device is manufactured by the following method. As typical with many plastic forming methods, the device of the present invention is made by one of the various molding techniques. The mold in which the invention is made is constructed with a pattern whereby the side walls diverge from the bight portion so that the device may be removed from the mold without interference by the side walls. Then the device is allowed to cool and contract whereby the resilient material of the side walls and the bight portion urges the side walls to converge together. In the exemplary embodiment, the mold is constructed such that the side walls diverge approximately 10 degrees relative to each other. The device is removed from the mold while still hot from molding. Thereafter, the devices are allowed to cool and the cooling causes a contraction in the resilient material from which the device is made. This contraction causes the side walls to converge and be urged against each other by the resiliency of the material. This provides for permanent resiliency of the side walls and assists in holding the device against the beverage glass or other flat object.

I claim:

1. A one piece molded plastic device including a body presenting an indicia receivable face and an integral clip having convergent side walls depending from an integral bight portion, the first of said side walls being connected to said body and the second of said side walls being longer than said first side wall and extending below said body, said clip being positionable over marginal portions along the free edge of a generally thin object, said body having a width substantially greater than the width of said first side wall, protrusion means comprising a pair of laterally spaced ribs formed integrally and longitudinally of said second side wall and protruding toward said body for gripping said marginal portions of said object therebetween, said rib means having a curved edge facing said object, the widest section of each rib being above the intersection of the body and the first of said side walls for better gripping of the object by the device, the improvement comprising the provision of:

deformable hinge means integral of said body and said clip where said first side wall is connected to said body for selectively adjusting the body between a position generally perpendicular to said first side wall to a position generally planar with said first side wall.

2. The improvement of claim 1 wherein said first of said side walls is tapered from a wider portion at the bight portion to a narrower portion near the hinge means for allowing the body to pivot relative to said first of said side walls along the curved edge of said body.

* * * * *